US008776288B1

(12) United States Patent
Regan et al.

(10) Patent No.: US 8,776,288 B1
(45) Date of Patent: Jul. 15, 2014

(54) BAFFLE BOX COMFORTER STRUCTURE DESIGNED TO RESIST SHIFTING OF FILL

(71) Applicants: Laura A. Regan, Bothell, WA (US); Tamara Soreano, Shoreline, WA (US)

(72) Inventors: Laura A. Regan, Bothell, WA (US); Tamara Soreano, Shoreline, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 13/887,203

(22) Filed: May 3, 2013

(51) Int. Cl.
*A47G 9/02* (2006.01)
*A47G 9/00* (2006.01)

(52) U.S. Cl.
CPC ..... *A47G 9/0223* (2013.01); *A47G 9/0207* (2013.01); *A47G 9/02* (2013.01)
USPC ..... 5/502; 5/482

(58) Field of Classification Search
CPC ..... A47G 9/0207; A47G 9/0223; A47G 9/02; A47C 31/007; A47C 31/05
USPC ..... 5/502, 500, 499, 486, 485, 482
See application file for complete search history.

(56) References Cited

U.S. PATENT DOCUMENTS 4,426,945 A * 1/1984 A-Yan ..... 112/475.08
5,987,669 A * 11/1999 Leggett et al. ..... 5/502
7,045,191 B2 * 5/2006 Huntley ..... 428/137
7,467,429 B2 * 12/2008 Soreano ..... 5/502
8,028,360 B2 * 10/2011 Regan et al. ..... 5/645
8,561,229 B2 * 10/2013 Regan et al. ..... 5/502
2006/0046024 A1 * 3/2006 Huntley ..... 428/137
2008/0201846 A1 * 8/2008 Soreano ..... 5/502
2011/0047699 A1 * 3/2011 Regan et al. ..... 5/502
2011/0179576 A1 * 7/2011 Regan et al. ..... 5/645
2013/0263375 A1 * 10/2013 Regan et al. ..... 5/500

* cited by examiner

*Primary Examiner* — Robert G Santos
(74) *Attorney, Agent, or Firm* — Jensen & Puntigam PS

(57) ABSTRACT

The baffle box comforter includes upper and lower fabric sections and a plurality of longitudinal baffle members which extend for the length of the comforter. A plurality of lateral baffles extend across the comforter, wherein each lateral baffle includes a first portion which extends from one side of the comforter to a first adjacent longitudinal baffle and a second portion which extends from the other side of the comforter to a second adjacent longitudinal baffle, and one or more central portions which are positioned between the first and second adjacent longitudinal baffles, wherein the first and second portions include end portions which extend along the first and second adjacent longitudinal baffles toward the top edge of the comforter a selected distance and the central portion or portions, including portions at both ends which extend along selected longitudinal baffles toward the top edge thereof, leaving an opening between the respective end portions and the longitudinal baffles to which they are adjacent.

6 Claims, 2 Drawing Sheets

BAFFLE BOX COMFORTER STRUCTURE DESIGNED TO RESIST SHIFTING OF FILL

TECHNICAL FIELD

This invention relates generally to baffle box type comforters with a baffle construction, and more specifically concerns such a comforter with a particular baffle structure.

BACKGROUND OF THE INVENTION

An important and desirable feature of bedding articles, particularly comforters, is maintaining the comforter fill in position, so that it does not move to the sides, i.e. away from the central area, during use. The shifting of the comforter fill is undesirable because it decreases the uniform warmth of the comforter and results in cold spots in areas where the fill has shifted. The internal structure of a comforter is thus often designed to prevent shifting. Various arrangements have been designed to prevent the shifting of fill, including what are known as baffle box comforters, which use baffles to divide a comforter into a plurality of squares or boxes. While it is important to prevent shifting of fill during use, it is also important to be able to conveniently fill the comforter during manufacture. These important objectives are often in conflict to some extent.

It is therefore desirable to have a comforter structure which permits convenient and inexpensive filling of the comforter during manufacture, but also prevents or significantly limits shifting of the fill during use.

DISCLOSURE OF THE INVENTION

Accordingly, a baffle box comforter is disclosed, comprising: an upper fabric section having lateral and longitudinal dimensions; a lower fabric section substantially identical to the upper fabric section; a plurality of longitudinal baffle members secured to and extending between the upper and lower fabric sections substantially along the lengths thereof; and a plurality of lateral baffles which extend across the comforter, secured to the upper and lower fabric sections, wherein the longitudinal baffles and the lateral baffles define baffle boxes within the comforter, wherein each lateral baffle includes a first portion which extends from one longitudinal side of the comforter to an adjacent first longitudinal baffle and a second portion which extends from the other longitudinal side of the comforter to an adjacent second longitudinal baffle and an additional portion or portions, if any, which is/are positioned between the first and second adjacent longitudinal baffles, wherein the first and second portions, respectively, each include an end section which extends a selected distance along the first and second longitudinal baffle, respectively, toward a top edge of the comforter, leaving a space between the end section and the longitudinal baffle, and wherein the additional baffle portion or portions include end sections which extend along selected longitudinal baffles toward the top edge of the comforter, leaving a space therebetween, so as to permit fill to be moved into each of the baffle boxes in the comforter through blow openings in a lower edge of the comforter.

BEST MODE FOR CARRYING OUT THE INVENTION

Figure 1:
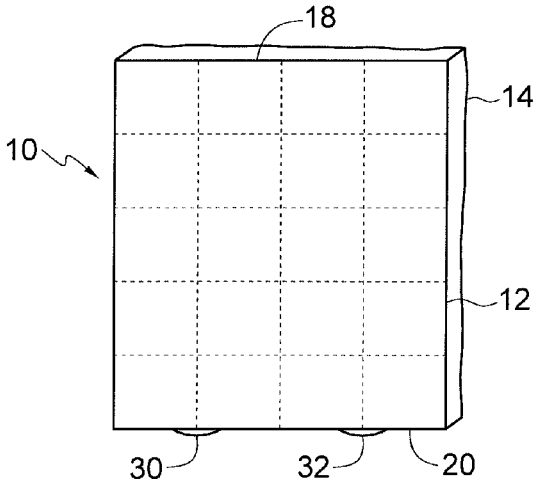
FIG. 1 is a general top view of the comforter shown and described herein, showing the upper and lower outer fabric sections of the comforter.

FIG. 1 shows a comforter 10 which includes an upper fabric layer 12 and a lower fabric layer 14. The upper and lower layers may be made from a variety of fabrics and may have various sizes and configurations, depending upon the size of the bed on which it is used. Standard, queen and king size are typical sizes, but there could be other sizes as well. A queen size comforter is, for instance, 88 inches long by 90 inches wide. Interior of the comforter are a plurality of baffles, including longitudinal baffles 15-17 which extend for the full length of the comforter from top edge 18 to bottom edge 20. Lateral baffles 22-25 extend across the entire width of the comforter, from side edge 26 to opposing side edge 28. The combination of longitudinal and lateral baffles form a plurality of baffle boxes, for example 29, over the area of the comforter. Typically the longitudinal and lateral baffles are equally spaced, leading to equal size boxes.

Figure 2:
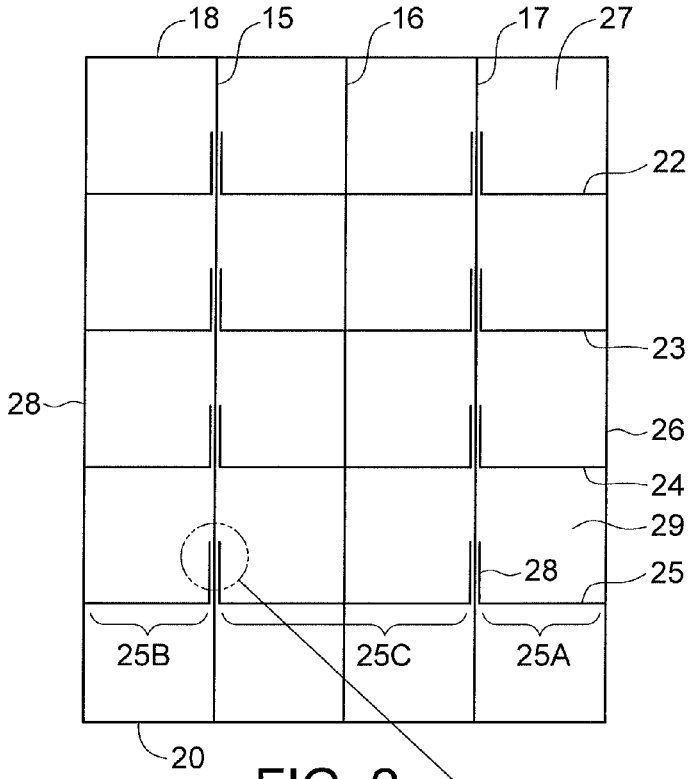
FIG. 2 is a cross-sectional view of the comforter of FIG. 1, showing the internal baffle structure of the comforter.

In the particular embodiment shown in FIGS. 1 and 2, there are three longitudinal baffles and four lateral baffles. However, the number of longitudinal and lateral baffles can vary, depending upon the size of the comforter. The longitudinal and lateral baffles are typically made from the same fabric. In the arrangement shown, more particularly in FIGS. 2 and 3, the longitudinal baffles 15-17 are conventional, each baffle typically being a single piece of fabric which is stitched or otherwise secured along its length to the upper and lower fabric sections 12 and 14, respectively.

The arrangement of the lateral baffles relative to the longitudinal baffles provide the advantages of the present comforter in permitting convenient filling of the comforter while preventing or significantly limiting the shifting of the fill within each of the boxes defined by the baffles to adjacent boxes.

Figure 3:
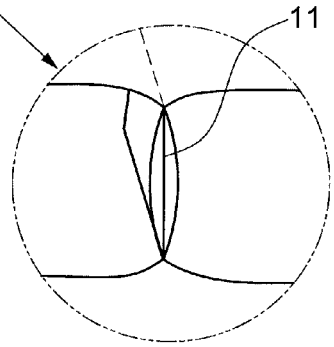
FIG. 3 is a cut-away view showing the particular arrangement of the baffle structure of the comforter of FIGS. 1 and 2.

Referring now specifically to FIGS. 2 and 3, each lateral baffle 22-25 will have the same arrangement in a particular comforter. The lowermost lateral baffle 25 is representative of all of the lateral baffles and will be discussed in detail. The lateral baffle 25 has a first portion 25A which extends from side 26 to a point substantially adjacent the nearest longitudinal baffle 17 and then bends 90° and extends along the longitudinal baffle toward the top edge 18 for a selected extension 28. The selected distance will vary within a range of three to eight inches for effective results, with a preferred length of approximately five inches. The lateral baffle section 25A is secured by stitching to the upper and lower fabric sections for its longitudinal length, and also attached to the upper and lower fabric sections along its longitudinal extension 28 by the same stitching as for the adjacent portion of the longitudinal baffle. The longitudinal extension of the lateral baffle section 25A is adjacent the nearest longitudinal baffle 17 but there is a space therebetween to permit fill to be moved therebetween into the box 29 during filling operation.

The very same arrangement is true for baffle section 25B of the upper baffle 22, which extends from the opposite side edge 28 to a point adjacent the nearest longitudinal baffle, 15 on that side and then extending along the longitudinal baffle for a selected distance, preferably five inches, toward the top edge 18 of the comforter.

For a comforter having three longitudinal baffles, each lateral baffle will include a central section 25C, which extends between the longitudinal baffle 15 and 17, across longitudinal baffle 16. The ends of baffle section 25C come adjacent the two longitudinal baffles 15 and 17, respectively, and then extend along those longitudinal baffles for a selected distance, preferably five inches, toward the top edge 18 of the comforter, similar to the longitudinal extensions of lateral baffle sections 25A and 25B, as shown in FIG. 2. The lateral portion of lateral baffle section 25C is secured to the upper and low fabric sections by stitching or similar elements, while the longitudinal extensions at the ends thereof are also secured to the upper and lower fabric sections, preferably with the same stitching used for the longitudinal baffles and the longitudinal extensions of baffle sections 25A and 25B, respectively.

Figure 4:
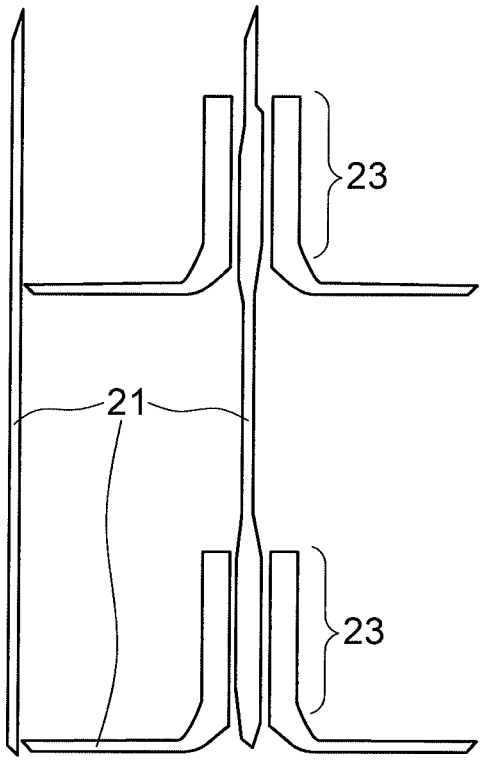
FIG. 4 is an exploded, detailed view of the baffle structure of FIGS. 1 and 2.

For the comforter shown with three longitudinal baffles, two blow openings 30 and 32 are provided at the lower edge 20 of the comforter straddling longitudinal baffles 15 and 17. The blow openings in the embodiment shown are approximately six inches wide, i.e. extending three inches to either side of the associated longitudinal baffle. This arrangement permits fill to be conveniently blown in to all of the boxes individually, through the space between the longitudinal extensions of the lateral baffles and the longitudinal baffles themselves. The close physical relationship and length of the longitudinal extensions of the lateral baffles is such as to prevent or significantly limit migration of fill from the individual boxes to other boxes. The height of the baffles, both longitudinal and lateral, is 0.75 inches in the present embodiment, shown at 21 in FIG. 4, although this could vary, except where the longitudinal and lateral baffles overlap (extend parallel). The height of the baffles in this area, shown at 23 in FIG. 4, is 2.75 inches, to accommodate the filling equipment. When filling is complete, the larger baffle portions simply collapse to approximately the height of the rest of the baffles.

The blow openings straddle two longitudinal baffles as discussed above. If there is only one longitudinal baffle between the two longitudinal baffles nearest the side edges of the comforter, such as shown in FIGS. 1 and 2, a single central baffle 16, as shown in FIG. 2, is sufficient. However, if additional central longitudinal baffles are included, such as three or five longitudinal baffles, a somewhat different arrangement of the central baffle portion is required. In such a situation, there will be additional central baffle portions, with each central baffle portion extending for two lateral boxes, across intervening longitudinal baffles. In the case of three central longitudinal baffles, the central section has two parts, each part covering two adjacent boxes, with the respective ends of each part arranged to extend along a longitudinal baffle for a selected distance. One part will extend from the longitudinal baffle nearest a side edge to one side of the middle longitudinal baffle while the other part will extend from the other side of the middle longitudinal baffle to the longitudinal baffle nearest the other side edge. Another blow opening is then provided straddling the middle longitudinal baffle, continuing the same arrangement as shown in FIG. 2. The pattern can be continued with each two additional longitudinal baffles.

Accordingly, a comforter has been disclosed having a particular arrangement of longitudinal and lateral baffles in which end portions of the lateral baffles extend a distance along the longitudinal baffles, toward the top edge of the comforter, with space between the end portions and the longitudinal baffles, thereby permitting convenient filling of the comforter while tending to prevent migration or movement of the fill from between individual boxes of the comforter.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A baffle box comforter, comprising:

an upper fabric section having lateral and longitudinal dimensions;

a lower fabric section substantially identical to the upper fabric section;

a plurality of longitudinal baffle members secured to and extending between the upper and lower fabric sections substantially along the lengths thereof; and a plurality of lateral baffles which extend across the comforter, secured to the upper and lower fabric sections, wherein the longitudinal baffles and the lateral baffles define baffle boxes within the comforter, wherein each lateral baffle includes a first portion which extends from one longitudinal side edge of the comforter to an adjacent first longitudinal baffle and a second portion which extends from the other longitudinal side edge of the comforter to an adjacent second longitudinal baffle and an additional portion or portions, if any, which is/are positioned between the first and second adjacent longitudinal baffles, wherein the first and second portions, respectively, each include an end section which extends a selected distance along the first and second longitudinal baffle, respectively, toward a top edge of the comforter, leaving a space between the end section and the longitudinal baffles, and wherein the additional baffle portion or portions include end sections which extend along selected longitudinal baffles toward the top edge of the comforter, leaving a space therebetween, so as to permit fill to be moved into each of the baffle boxes in the comforter through blow openings in a lower edge of the comforter.

2. The comforter of claim 1, wherein the selected distance is within the range of three to eight inches.

3. The comforter of claim 2, wherein the selected distance is approximately five inches.

4. The comforter of claim 1, wherein the longitudinal baffles are secured to the upper and lower fabric sections by lines of stitching, wherein lateral portions of the lateral baffles are secured to the upper and lower fabric sections by lines of stitching, and wherein the end sections of the lateral baffles are secured to the upper and lower fabric sections by lines of stitching which secure the longitudinal baffles to the upper and lower fabric sections.

5. The comforter of claim 1, wherein the comforter includes three longitudinal baffles, and wherein the lateral baffles include one additional portion which extends between the first and second adjacent longitudinal baffles, with end sections which extend a selected distance along the adjacent longitudinal baffles, with a space therebetween to permit entry of fill.

6. The comforter of claim 1, including five longitudinal baffles, and wherein the additional portion of each lateral baffle includes two parts, wherein a first part extends between the first adjacent longitudinal baffle and a central longitudinal baffle from the first and second adjacent longitudinal baffles and wherein a second part extends from the other adjacent longitudinal baffle to the central longitudinal baffle and wherein the comforter includes blow openings at the bottom edge of the comforter straddling the two adjacent longitudinal baffles and the central longitudinal baffle.

* * * * *